United States Patent [19]

Obrist

[11] Patent Number: 4,673,107

[45] Date of Patent: Jun. 16, 1987

[54] TWO-COMPARTMENT DOSING PACKAGE

[75] Inventor: Gerhard Obrist, Kaiseraugst, Switzerland

[73] Assignee: Sterling Drug, Inc., New York, N.Y.

[21] Appl. No.: 638,504

[22] Filed: Aug. 7, 1984

[30] Foreign Application Priority Data

Aug. 16, 1983 [CH] Switzerland ..... 4450/83

[51] Int. Cl.[4] ..... B65D 83/14; G01F 11/36

[52] U.S. Cl. ..... 222/94; 222/95; 222/135; 222/402.2

[58] Field of Search ..... 222/94, 95, 135, 402.20

[56] References Cited

U.S. PATENT DOCUMENTS

| | | | |
|---|---|---|---|
| 2,671,578 | 3/1954 | McBean | 222/95 |
| 3,169,670 | 2/1965 | Hrebenak et al. | 222/95 |
| 3,225,967 | 12/1965 | Heimgartner | 222/95 X |
| 3,565,290 | 11/1968 | Prussin . | |
| 3,581,941 | 6/1971 | Bruce et al. | 222/95 |
| 3,592,359 | 7/1971 | Marraffino . | |
| 3,637,114 | 1/1972 | Meshberg | 222/135 |
| 3,730,437 | 5/1973 | Rousselot | 222/94 X |
| 4,433,797 | 2/1984 | Galia | 222/402.20 |

FOREIGN PATENT DOCUMENTS

| | | | |
|---|---|---|---|
| 0062609 | 10/1982 | European Pat. Off. . | |
| 1908960 | 9/1970 | Fed. Rep. of Germany . | |
| 1190685 | 4/1959 | France . | |
| 495894 | 9/1970 | Switzerland . | |
| 1115926 | 6/1968 | United Kingdom | 222/402.20 |
| 1327800 | 8/1973 | United Kingdom | 222/402.20 |

*Primary Examiner*—Joseph J. Rolla
*Assistant Examiner*—Frederick R. Handren
*Attorney, Agent, or Firm*—Werner K. Kleeman

[57] ABSTRACT

An inner container having a dispensing valve is situated within a flexible sack which in turn is situated within an outer container having a cover and a dispensing valve. The sack contains one package component and the inner container contains the other package component and a propellant. A further propellant is situated outside of the sack within the outer container. The inner dispensing valve is constructed as a dosage valve and issues into the interior of the outer dispensing valve. The latter is kinematically coupled with the inner dispensing valve and possesses a blocking system which blocks its interior relative to the interior of the sack when the outer dispensing valve is open. The particular construction and the flow-related coupling of both dispensing valves permits a defined dosed dispensing of both package components with a defined mixture ratio.

5 Claims, 2 Drawing Figures

34
35
32
33
36
A
2
43
40
40
3
31
41
42
39
37
38
71
6
8
7
83
82
82
6
72
4
5
1
B
T1
T2
B
A 34
33
32
A+B
36
31
43
40
3
40
42
41
37
39
38
71
8
6
83
82
82
6
7
72
4
5
1
$T_1$
B
$T_2$
B
A

TWO-COMPARTMENT DOSING PACKAGE

BACKGROUND OF THE INVENTION

The present invention broadly relates to two-compartment dosing packages and, more specifically, pertains to a new and improved construction of a two-compartment dosing package comprising an outer container having an interior space for a first package component, a cover provided on the outer container and a first dispensing valve mounted in the cover. An inner container for a second package component and for a propellant is arranged within the outer container. A second dispensing valve is provided for the inner container as are means for coupling the first and second dispensing valves such that opening the first dispensing valve also opens the second dispensing valve and both first and second package components are jointly dispensed through the first dispensing valve.

SUMMARY OF THE INVENTION

An important object of the present invention aims at providing a new and improved construction of a two-compartment dosing package of the previously mentioned type in which a joint dispensing of both package components in dosed quantities and in precisely defined proportions is reliably obtained.

It is a further particular object of the present invention to achieve good mixing of both package components when they are dispensed.

Yet a further significant object of the present invention aims at providing a new and improved construction of a two-compartment dosing package of the character described which is relatively simple in construction and design, extremely economical to manufacture, highly reliable in operation, and not readily subject to breakdown and malfunction.

Now in order to implement these and still further objects of the invention, which will become more readily apparent as the description proceeds, the two-compartment dosing package of the present invention is manifested by the features that it comprises a hollow stem for operating the first dispensing valve and for jointly dispensing the first and second package components as well as a dosage chamber provided for the first dispensing valve. The dosage chamber communicates with the interior space of the outer container when the first dispensing valve is closed, and when the first dispensing valve is open the dosage chamber is closed relative to the outer container and is connected with the exterior of the two-compartment dosing package via the hollow stem. The second dispensing valve is flow-communicatingly connected with the dosage chamber and is constructed as a dosage valve for dispensing a predetermined quantity of the second package component into the dosage chamber during each operation of the second dispensing valve.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
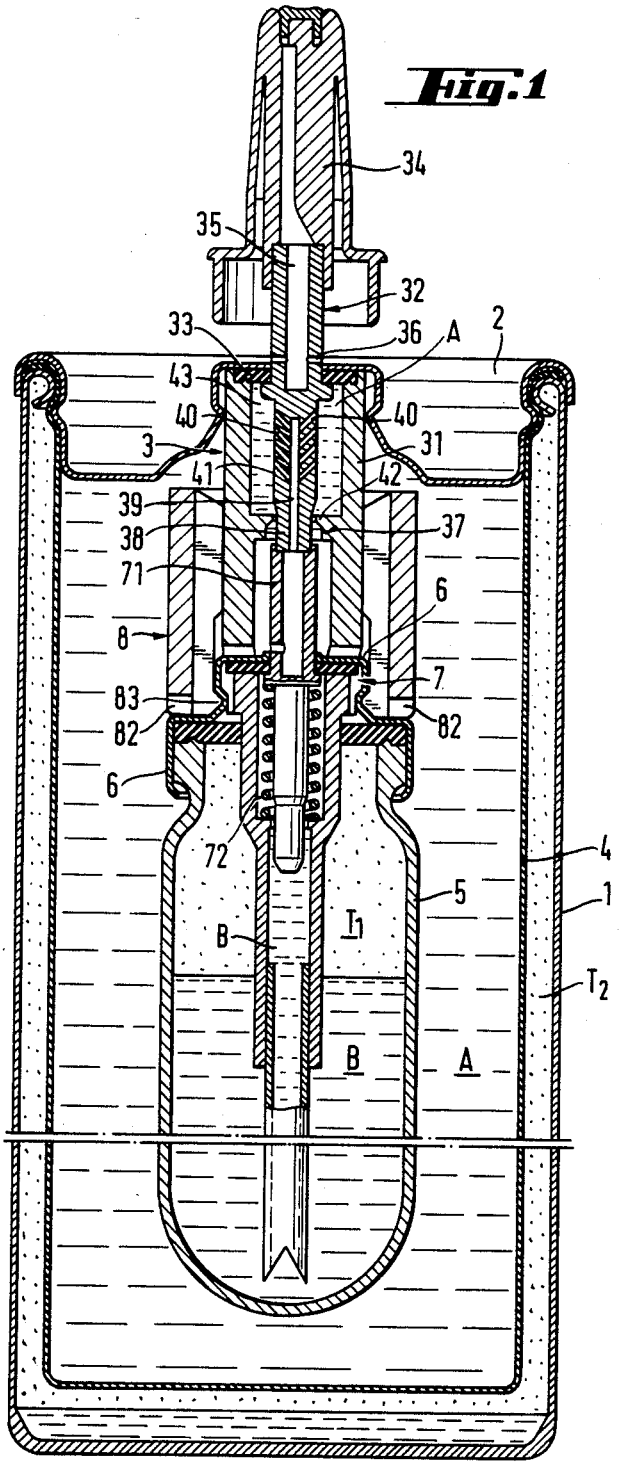
FIG. 1 shows a cross-section through a two-compartment dosing package according to the invention with the dispensing valves in their closed positions.

Describing now the drawings, it is to be understood that to simplify the showing thereof only enough of the structure of the two-compartment dosing package has been illustrated therein as is needed to enable one skilled in the art to readily understand the underlying principles and concepts of this invention. Turning now specifically to FIG. 1 of the drawings, the structure illustrated therein by way of example and not limitation will be seen to comprise a dimensionally stable outer container 1 having a cover 2 and a first outer dispensing valve 3 mounted in the cover 2, a flexible sack or bag 4, an inner container 5 having a cover 6 and a second inner dispensing valve 7 and an adapter member 8 with which the inner container 5 is fastened to the first outer dispensing valve 3 in the outer container 1 within the flexible sack 4.

The flexible sack 4 accommodates a first package component A and the inner container 5 contains a second package component B as well as a suitable propellant medium or propellant $T_1$. In the intermediate space between the flexible sack 4 and the inner wall or surface of the outer container 1 there is a further propellant medium or propellant $T_2$.

The first outer dispensing valve 3 of the outer container 1 is mounted in the cover 2 of such outer container 1 by means of its substantially cylindrical valve housing 31. In addition to the just mentioned valve housing 31, the first outer dispensing valve 3 also comprises an operating and dispensing tubelet or hollow stem 32 arranged coaxially in the housing 31 so as to be inwardly and outwardly movable and an elastic gasket or sealing disk 33. The stem 32 is made hollow in its upper portion and is open at the top and is provided with lateral valve apertures or openings 36 issuing into its hollow space and which form conjointly with the gasket disk 33 the actual dispensing valve.

Figure 2:
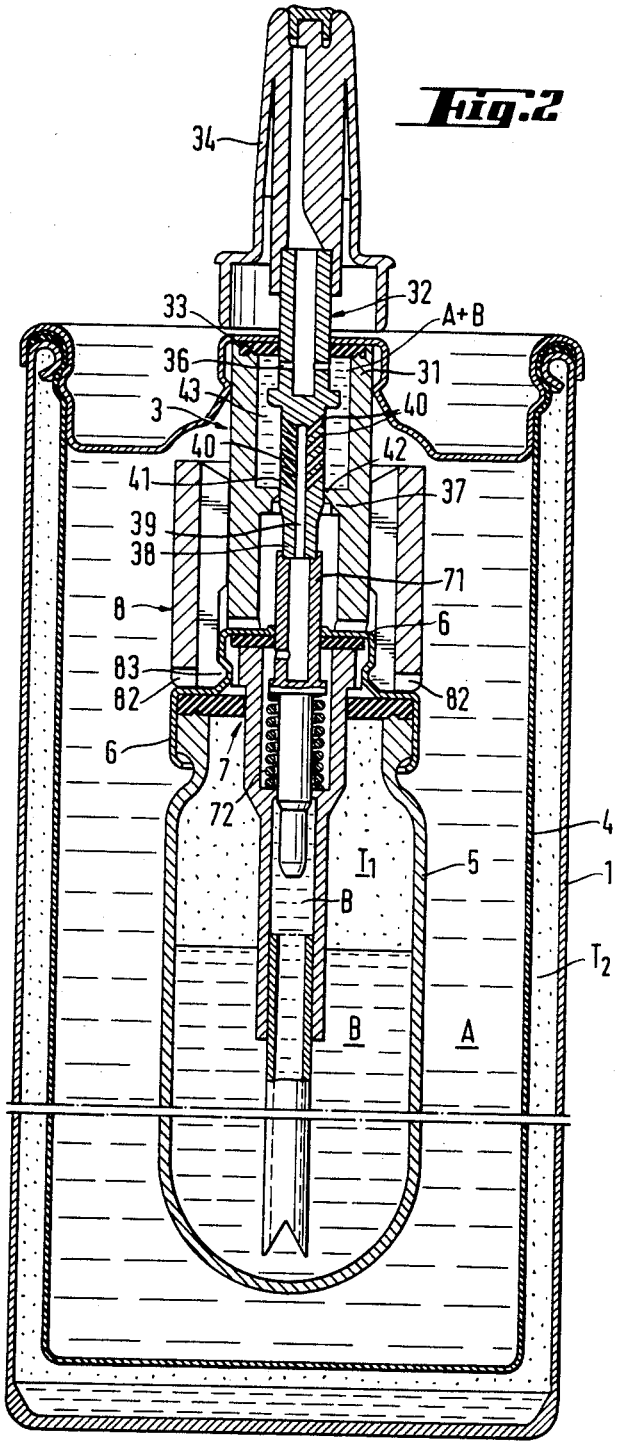
FIG. 2 shows an analogous cross-section with the dispensing valves in their open position.

In the closed state (cf. FIG. 1), the valve apertures or openings 36 are situated outside of the gasket disk 33 and there is therefore no connection to the interior of the container or package. When the first outer dispensing valve 3 is open, these apertures 36 lie below the gasket disk 33 and the package components contained in the valve housing 31 can therefore—through the action of the propellants in the containers 1 and 5—flow from the valve housing 31 through the valve apertures 36 and the internal hollow space 35 of the stem 32 to the exterior and be dispensed. As shown in FIGS. 1 and 2, an operating and dispensing tip or knob 34 adapted to the individual application can be mounted upon the hollow stem 32.

The adapter member 8 is seated upon the substantially cylindrical valve housing 31 and is retained by a press fit or snap action or an elastic ring insert or other suitable means. This adapter member 8 is substantially tubular and has lateral transmission ports 82. It is provided with grippers or hooks 83 or other suitable means at its lower end which engage the cover 6 of the inner container 5 and retain the latter firmly in place.

The second inner dispensing valve 7 of the inner container 5 mounted in the cover 6 is, for instance, a commercially available dosage or dosing valve which dispenses a pre-defined quantity of the second package component B each time that it is opened by depressing its operating and dispensing tubelet or hollow stem 71. Such dosage valves are generally known and available in the marketplace and therefore will not be described in more detail here. The construction and operation of such dosage valves are analogous to those of the first outer dispensing valve 3 and are readily ascertainable from the drawings.

The hollow stem 71 of the second inner dispensing valve 7 of the inner container 5 is arranged coaxially to the hollow stem 32 of the first outer dispensing valve 3 of the outer container 1 and is thrust-contactingly connected with the former by means of an extension 38, so that when the outer dispensing valve 3 is opened, the inner dispensing valve 7 is also simultaneously opened. The return to the closed position is effected jointly for both dispensing valves 3 and 7 by the force of the return spring 72 of the dispensing valve 7.

The lower portion or section and the extension 38 of the hollow stem 32 of the outer dispensing valve 3 are provided with an axial channel 39 which communicates with the hollow stem 71 of the inner dispensing valve 7 of the inner container 5. A number of radially arranged nozzle-like channels 40 extending diagonally upward from the interior toward the exterior connect the axial channel 39 with the interior of the valve housing 31.

The central portion or section 41 of the hollow stem 32 in which the diagonal connecting channels 40 are situated is somewhat larger in diameter than the subsequent extension 38 and cooperates with a gasket or sealing lip 42 provided at a constriction 37 of the valve housing 31 such that the valve housing 31 is open downwardly when the outer dispensing valve 3 is closed (cf. FIG. 1). Transmission of the first component A from the interior of the outer container 1 through the adapter member 8 into the valve housing 31 is inhibited when the outer dispensing valve 3 is open (cf. FIG. 2), and the interior of the valve housing 31 forms a dosage chamber 43 having a defined dosage volume. In other words, the hollow stem 32 has two mutually stepped sections 38 and 41 cooperating with the sealing lip 42 such that the valve housing 31 communicates with the interior of the package only when the outer dispensing valve 3 is closed.

When the dispensing valves 3 and 7 are closed, the propellant medium $T_2$ between the sack 4 and the outer container 1 presses the package component A contained in the sack 4 into the dosage chamber 43 formed by the valve housing 31. When both dispensing valves 3 and 7 are opened, the dosage chamber 43 is closed downwardly or against the interior of the package but is also opened to the exterior via the hollow stem 32. Simultaneously, the propellant medium $T_1$ of the inner container 5 presses a defined quantity of the second package component B through the dosage valve defined by the inner dispensing valve 7 via the channels 39 and 40 into the dosage chamber 43. There both components mix and a quantity of package component mixture corresponding to the quantity dispensed by the dosage valve 7 is displaced and dispensed. When the dispensing valves 3 and 7 are closed, the propellant medium $T_2$ refills the dosage chamber 43 with the first package component A. The process just described then repeats itself. A reliably dosed dispensing of both package components in defined mutual mixture proportions is obtained in this manner.

In the exemplary embodiment described above, the outer container 1 is constructed as a two-chamber system. 0f course it is also possible—according to the type of package component—to renounce the flexible sack 4 and to dispose the propellant medium $T_2$ conjointly with the package component A directly in the outer container 1.

While there are shown and described present preferred embodiments of the invention, it is to be distinctly understood that the invention is not limited thereto, but may be otherwise variously embodied and practiced within the scope of the following claims.

Accordingly, what I claim is:

1. A two-compartment package, comprising:

an outer container for a first package component and having an interior space;

a cover provided on said outer container;

a first dispensing valve mounted in said cover;

an inner container for a second package component and for a propellant and arranged within said outer container;

a second dispensing valve provided for said inner container;

said outer container being constructed as a two-chamber system;

said two-chamber system comprising a flexible sack arranged within said outer container for containing said first package component and said inner container;

said flexible sack and said outer container defining an intermediate space therebetween;

a propellant occupying said intermediate space for pressing said first package component into said first dispensing valve;

a hollow stem for operating said first dispensing valve and for jointly dispensing said first and second package components;

a housing in said outer container defining a dosage chamber provided for said first dispensing valve;

said hollow stem comprising a coaxially hollow extension extending into said dosage chamber;

said extention having a valving surface thereon which effects the opening and closing of said dosage chamber with respect to said outer container;

said sodage chamber communicating with said interior space of said outer container when said first dispensing valve is closed;

said dosage chamber being closed relative to said outer container and connected with the exterior of the two-compartment package via said hollow stem when said first dispensing valve is open;

said second dispensing valve being flow-communicatingly connected with said dosage chamber;

said second dispensing valve being constructed as a dosage valve for dispensing a pre-determined quantity of said second package component into said dosage chamber during each operation of said second dispensing valve; and means for coupling said first and second dispensing valves such that opening said first dispensing valve concurrently opens said second dispensing valve and both said first and second package components present in said dosage chamber are jointly dispensed through said first dispensing valve.

2. The two-compartment package as defined in claim 1, further including:

an adapter member for fastening said inner container substantially coaxially with said housing.

3. The two-compartment package as defined in claim 2, wherein:

said second dispensing valve comprises an operating and dispensing tubelet; and said hollow stem being communicatingly and kinematically connected with said operating and dispensing tubelet of said second dispensing valve of said inner container.

4. The two-compartment package as defined in claim 3, wherein:

said hollow stem is provided with a plurality of connecting channels issuing laterally into said dosage chamber.

5. A two-compartment package, comprising:

an outer container for a first package component and having an interior space;

a cover provided on said outer container;

a first dispensing valve mounted in said cover;

an inner container for a second package component and for a propellant and arranged within said outer container;

a second dispensing valve provided for said inner container;

said outer container being constructed as a two-chamber system;

said two-chamber system comprising a flexible sack arranged within said outer container for containing said first package component and said inner container;

said flexible sack and said outer container defining an intermediate space therebetween;

a propellant occupying said intermediate space for pressing said first package component into said first dispensing valve;

a hollow stem for operating said first dispensing valve and for jointly dispensing said first and second package components;

a dosage chamber provided for said first dispensing valve;

said dosage chamber communicating with said interior space of said outer container when said first dispensing valve is closed;

said dosage chamber being closed relative to said outer container and connected with the exterior of the two-compartment package via said hollow stem when said first dispensing valve is open;

said second dispensing valve being flow-communicatingly connected with said dosage chamber;

said second dispensing valve being constructed as a dosage valve for dispensing a pre-determined quantity of said second package component into said dosage chamber during each operation of said second dispensing valve;

means for coupling said first and second dispensing valves such that opening said first dispensing valve concurrently opens said second dispensing valve and both said first and second package components present in said dosage chamber are jointly dispensed through said first dispensing valve;

a housing forming said dosage chamber of said first dispensing valve of said outer container;

an adapter member for fastening said inner container substantially coaxially with said housing;

said second dispensing valve comprising an operating and dispensing tubelet;

said hollow stem of said first dispensing valve of said outer container comprising a coaxially hollow extension;

said hollow stem being communicatingly and kinematically connected with said operating and dispensing tubelet of said second dispensing valve of said inner container;

a sealing lip provided in said housing;

said hollow stem comprising a first section having a first outside diameter and a second section having a second outside diameter;

said first outside diameter being greater than said second outside diameter such that said first section and said second section define two mutually stepped sections;

said sealing lip having an inside diameter less than said first outside diameter and greater than said second outside diameter;

said second outside diameter extending within said inside diameter with clearance when said first dispensing valve is closed; and said two mutually stepped sections cooperating with said sealing lip such that said housing communicates with said interior space of said outer container only when said first dispensing valve is closed.

* * * * *

UNITED STATES PATENT AND TRADEMARK OFFICE

CERTIFICATE OF CORRECTION

PATENT NO. : 4,673,107

DATED : June 16, 1987

INVENTOR(S) : GERHARD OBRIST

It is certified that error appears in the above-identified patent and that said Letters Patent is hereby corrected as shown below:

Column 4, line 42, please delete "extention" and insert --extension--

Column 4, line 45, please delete "sodage" and insert --dosage--

Signed and Sealed this

Twenty-fourth Day of November, 1987

*Attest:*

DONALD J. QUIGG

*Attesting Officer*

*Commissioner of Patents and Trademarks*